United States Patent [19]

Esposito

[11] Patent Number: 4,942,864

[45] Date of Patent: Jul. 24, 1990

[54] STOVE-TOP SAFETY GRATE FLAME DEFLECTOR

[76] Inventor: Frank Esposito, 83-15 13th Ave., Apt. 1, Brooklyn, N.Y. 11228

[21] Appl. No.: 394,580

[22] Filed: Aug. 16, 1989

[51] Int. Cl.[5] ..... F24C 15/10

[52] U.S. Cl. ..... 126/214 D; 126/214 R

[58] Field of Search ..... 126/214 R, 214 C, 214 D

[56] References Cited

U.S. PATENT DOCUMENTS

| | | | |
|---|---|---|---|
| 1,678,269 | 7/1928 | Pickup | 126/214 C |
| 2,565,726 | 8/1951 | Garrison | 126/215 |
| 2,861,563 | 11/1958 | Jensen | 126/214 C |
| 3,187,742 | 6/1965 | Powers | 126/214 C |
| 3,583,384 | 6/1971 | Ranisate | 126/215 |
| 4,059,092 | 11/1977 | Bourboulis | 126/215 |
| 4,126,120 | 11/1978 | Bourboulis | 126/214 C |
| 4,448,186 | 5/1984 | Smith | 126/214 D |

*Primary Examiner*—Carroll B. Dority

*Attorney, Agent, or Firm*—Morgan & Finnegan

[57] ABSTRACT

A flame deflector is disclosed for use on gas stove burner grates. The deflector includes a top deflector and lower skirt/mounting member. The top deflector plate serves to keep rising flames from heating a cooking utensil handle. The skirt/mounting member keeps the device from moving on the burner grate. The invention is suitable for use on all burner grates regardless of the shape and size, and a variety of embodiments are disclosed for mounting the invention on different burner grates.

20 Claims, 4 Drawing Sheets

STOVE-TOP SAFETY GRATE FLAME DEFLECTOR

BACKGROUND AND OBJECTS OF THE INVENTION

1. Field of the Invention

The present invention relates generally to stove-top grates and, more particularly, to stove-top flame deflectors that can be added to existing stove grates, or formed integrally with a stove grate, to deflect the flames emerging from the stove burner away from the handle of the cooking utensil being heated (e.g., a pot handle) so that the handle does not become excessively hot, yet the invention will not appreciably diminish the heating effect on the food within the utensil.

2. Description of the Prior Art

Today's gas cook stoves typically comprise a flat top surface having one or more openings, with a gas burner set in each opening, and a corresponding number of raised stove grates resting on the stove top, generally above and surrounding the burners to provide a cooking surface spaced from the burner. Cooking implements such as pots and pans are thus placed on the stove grates above the burners to allow the flame to spread out for increasing the surface actually heated by the gas flames emanating from the burner.

Stove grates are typically formed from a round or square outer frame and have a number of long fingers extending radially inwardly from the outer frame. These fingers can be separate members joined at one end to an outer frame, or can be extensions of the outer frame itself. Generally, the fingers do not extend so far inward from the outer frame as to touch at the grate's center. Rather, the inner ends usually describe an open area of circular shape about the burner. Another style of stove grate has a small circular center ring from which a number of fingers extend outwardly. The latter style grate may have no outer frame. The size, shape and orientation of the grate fingers all vary with stove grate design, and the number of grate fingers typically ranges from 4–8.

Depending on the intensity of the gas flame and the cooking utensil used, the flame may touch and run along the bottom or even up the sides of the utensil. Should the flame spill up along the side of the cooking utensil near the handle, it will generally cause the handle to become dangerously hot. Although perceptive users can minimize this problem by either reducing the flame size or using a pot-holder, neither solution is satisfactory. Lowering the flame increases cooking times, and the food's quality may be compromised. Grasping the handle with a potholder does nothing to reduce its temperature; anyone forgetting to use a potholder to grasp the handle may be burned.

Thus, there exists a genuine need for a device that limits or prevents handle heating and is simple, reliable and inexpensive to manufacture, and is suitable for mounting on pre-existing stove grates as well as being incorporated integrally with a grate. Prior known flame deflectors have generally not been satisfactory.

U.S. Pat. No. 3,187,742, issued to Powers, discloses a gas burner flame shield intended to prevent cookware handles from growing too hot. The several embodiments taught therein all share a common feature, namely, a vertical or slanted shield intended to limit how far outward the flame can extend. This shield only blocks a section of the flame emerging from the burner.

U.S. Pat. No. 1,922,420, issued to Coulston, teaches an attachment for open top flame stoves. It is a two piece device that fastens to the grate. The top part of the device is discoidal, and has a lower lip around its circumference. This part of the device serves to contain a large flame and prevents it from spilling up along the cookware edges. The device deflects all flames leaving the burner.

Finally, U.S. Pat. No. 1,196,602, issued to Smith, pertains to a hooked handle guard that can be removably attached to a cooking implement's handle. The handle guard hook engages the implement's handle and the handle guard has a horizontal plate which deflects the heat of the flame from the handle.

None of the foregoing devices, however, fulfill the need for an easily installed, securely mounted flame deflector suitable for use on virtually any type of stove grate to prevent the handle of cookware from becoming dangerously hot.

OBJECTS OF THE INVENTION

It is therefore an object of the present invention to provide a stove flame deflector for use on gas stoves which deflector prevents a cooking utensil's handle from growing excessively hot.

Yet another object of the present invention is to provide a stove flame deflector that is relatively inexpensive to manufacture.

An additional object of the instant invention is to provide a stove flame deflector that can be easily mounted on pre-existing stove grates.

Another object of the present invention is to provide a stove flame deflector which enables users to readily determine where they should put a cooking utensil's handle to keep it from becoming too hot.

Objects and advantages of the invention are set forth in part herein and in part will be obvious herefrom, or may be learned by practice with the invention, the same being realized and attained by means of the instrumentalities and combinations pointed out in the appended claims. The invention thus consists in the novel parts, constructions, arrangements, combinations, steps and improvements herein shown and described.

It will be understood that the foregoing general description and the following detailed description as well are exemplary and explanatory of the invention but are not restrictive thereof. The accompanying drawings, referred to herein and constituting a part hereof, illustrate preferred embodiments of the invention, and together with the description, serve to explain the principles of the invention.

SUMMARY OF THE INVENTION

The present invention is a simple structure which can be quickly mounted on pre-existing stove grates. This device, which is mounted above several of the stove grate's fingers, serves to deflect the rising gas flames out from under the utensil's handle, thereby reducing how hot the handle becomes. The device can be made from sheet metal or any other material that does not soften or melt at very high temperatures.

Briefly, the invention includes an upper deflector plate, shaped like a truncated wedge, which can rest atop either one or two fingers of the stove grate, depending on the configuration of the stove-top grate. In addition, a protective skirt/mounting assembly projects angularly inwardly from the bottom of the deflector plate both to help ensure that the flame does not escape from the back of the device and to secure the device to the stove grate.

Advantageously, the upper deflector plate may be perforated by a number of holes, or crescent-shaped slots, all preferably located inwardly of the skirt-/mounting member to improve heat transfer to the cooking utensil for even heating without affecting the protection afforded by the device. These perforations or slots allow some flame to contact directly the bottom of the utensil, while helping to vent the flame otherwise "captured" by the upper plate. Stabilizer tabs may also be provided near the inner portion of the deflector to help stabilize the upper plate when it rests atop a single finger.

The skirt/mounting assembly can have a variety of shapes depending on the particular stove grate to which the device is attached. In one embodiment, a single plate having slots or notches which correspond in size and number to the covered plate fingers projects downwardly from the upper deflector plate and has a pair of extensible-retractable shutters slidably mounted to the plate to secure the device to the grate. The shutters preferably are notched to allow for, and closely border, the grate fingers to substantially close off flame access to the back of the device.

In another embodiment, the skirt/mounting assembly may comprise a crimped or pleated strip of metal, having slitted apexes which grasp the grate fingers. In still another embodiment, the skirt/mounting assembly may comprise a slitted plate attachable to the bottom of the deflector plate, the slits forming bendable tabs which yield to accommodate the grate fingers. Alternatively, the plate may be pre-notched according to the expected configuration of the fingers of the stove top grate.

Persons using the invention can readily determine where on the stove grate they should put a cooking utensil's handle by simply looking at the stove grate's surface. The "safe" zone, where the handle is protected, lies directly above the wedge-shaped upper deflection plate, radially outward of any vent holes or slots. Thus, for the handle to stay sufficiently cool to allow hand contact by users, it need only be positioned over the deflection plate and outward of the vents.

An important advantage of the invention is that it serves as a guide so that users can readily ascertain where to position the handle of the pot or other cooking utensil. This advantage is particularly significant when children are in the household who might accidentally grab the handle of a hot pot if the handle is hanging over the front edge of the stove. To eliminate this risk, each stove top grate safety deflector according to the invention is preferably located on the side of each grate rather than the front edge. Thus, for example, in the usual four-burner stove, the deflectors for the burners on the left side (as seen by someone looking down from the front of the stove) are preferably at about the "9-o'clock" position and those on the right hand side are at about the "3-o'clock" position.

Stove grates come in a variety of shapes and sizes. The present invention is specifically designed to be mounted on all types of stove grates regardless of their size or shape. This invention in its broadest aspect comprises two parts, an upper flame deflector plate, and a protective skirt/mounting member depending from the deflector. The deflector is adapted to sit atop one or more of the grate's fingers, and coacts with the skirt-/mounting member to securely affix the device to the grate fingers.

BRIEF DESCRIPTION OF THE DRAWINGS

The accompanying drawings, referred to herein and constituting a part hereof, illustrate the preferred embodiments of the stove top grate safety shield according to the present invention, and together with the detailed description hereafter serve to explain the principles of the invention.

DETAILED DESCRIPTION OF THE PREFERRED EMBODIMENTS

Figure 1:
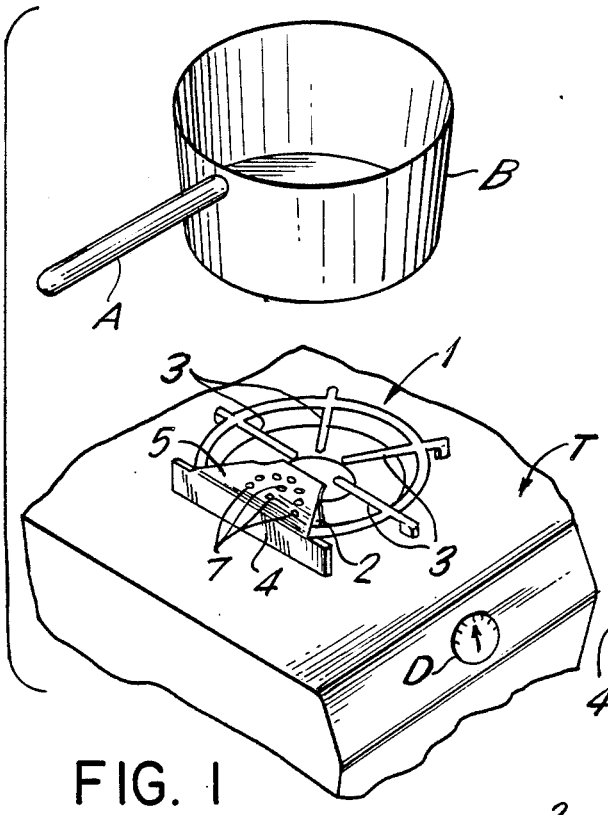
FIG. 1 is a perspective view showing one embodiment of the present invention installed on a stove grate.

Because gas cook stoves are manufactured with stove grates of varying form, the present invention incorporates a mounting system that is sufficiently flexible to allow the invention to be attached to virtually any different type of stove-top grate available. While the several different embodiments set forth below differ primarily with respect to their skirt/mounting assembly, they all include the basic structure of the stove-top flame deflector of the invention—namely, a flat, wedge-shaped upper plate and an angled protective skirt which forms part of the mounting assembly and also serves as an added flame deflector.

Referring now to the drawings, and in particular to FIGS. 1–3*b*, there is depicted one embodiment of the present invention, comprising two parts, an upper deflection plate 5, and a lower protective skirt/mounting assembly 9. As here embodied, the deflector plate 5 has the general shape of a truncated wedge which covers only so much of the stove grate (1) as to shield a pot handle (A) from the flame yet provide substantial contact between the flame and the pot (B). Plate 5 also has two side-edge lips 2 which extend downwardly from plate 5 by a distance no less than about the depth of grate fingers 3. There is also a back-edge lip 4 which is proportioned generally to rest upon the stove-top (T) while the bottom surface of plate 5 rests on the top edges of stove grate fingers 3.

As shown in FIGS. 1–3*b*, edge lips 2 and 4 are preferably formed integrally with, and bent downwardly from deflection plate 5. The deflection plate 5 and the edge lips 2 and 4 are dimensioned so that when the deflection plate 5 is placed atop a stove grate, it generally covers two adjacent fingers 3. This should provide an ample "safe zone" to protect the handle (A) from being heated. The edge lips help to restrain the device 5 from sliding laterally on the stove grate. Also, lip 4 may have ends which extend beyond lips 2 (as shown) for added flame protection or it may terminate generally at the back edges of lip 2. (This is true of all embodiments disclosed herein.)

Deflection plate 5 is advantageously perforated by a plurality of vent holes 7 to allow some of the flame to be in direct contact with the pot. These holes, each approximately ¼ in diameter, improve heat transfer to the cooking utensil bottom. They also allow some flame to escape from beneath deflection plate 5, reducing the amount of flame that must be deflected and which might otherwise spill out around the edges of deflection plate 5.

Figure 3A:
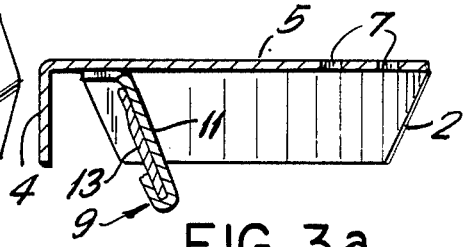
FIG. 3*a* is a cross-sectional view along 3*a*—3*a* in FIG. 3.
Figure 3B:
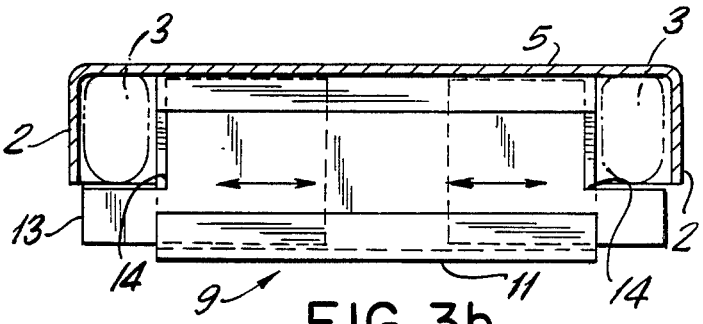
FIG. 3*b* is a cross-sectional view along 3*b*—3*b* in FIG. 3.
Figure 3:
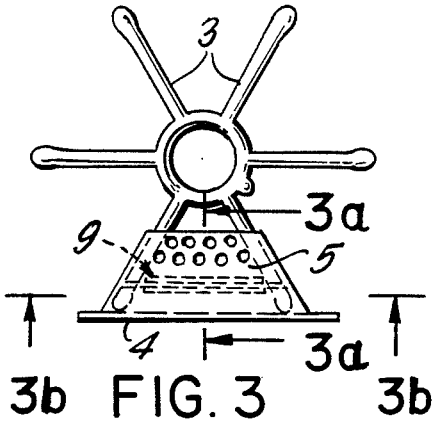
FIG. 3 is a top plan view of another embodiment of the invention, which also illustrates mounting to a frameless stove grate.

Also advantageously skirt/mounting member 9 is adapted to span essentially the entire gap between the two edge lips 2 to keep flame from spilling rearwardly, and in accordance with the most preferred form of the invention, skirt/mounting member 9 is adapted both to close the gap with lips 2 and to secure the device to the stove grate. To this end, as shown in FIGS. 3–3*b*, skirt/mounting member 9 includes a pair of extendable/retractable shutters. Member 9 may comprise a C-shaped plate 11 (having both its top and bottom edges folded over each other) and two flat shutter plates 13.

The shutter plates 13 are slidably held in the oppositely disposed slots formed by the folded over edges of plate 11 and can be moved between retracted and extended positions to vary the width of skirt/mounting member 9. Each shutter plate 13 preferably has a notch 14 in its upper outermost corners. These notches 14 are shaped to conform to finger 3 and allow the shutter plates 13 to generally seal off the area behind skirt/mounting member 9. In addition, the portions of shutter plates 13 disposed beneath finger 3 when shutters 13 are fully extended secures the entire device to the stove grate and prevent it from being lifted off the stove grate. Skirt/mounting member 9 can be fabricated separately from deflection plate 5 and can be joined to deflection plate 5 by any well-known fastening technique, including welding, soldering, brazing, riveting, etc.

Figure 2:
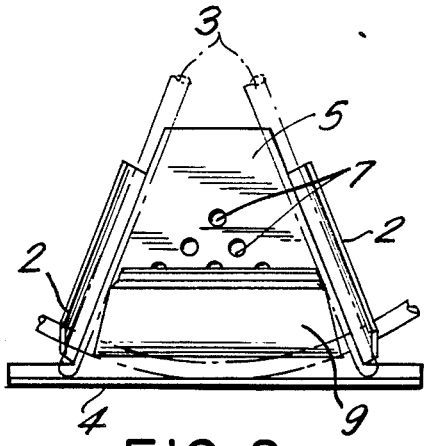
FIG. 2 is a bottom plan view, from underneath, of the embodiment depicted in FIG. 1.

It will be understood that FIGS. 1 and 2 depict the most basic concept of the invention wherein skirt/mounting member 9 is simply a plate-like skirt which is proportioned to ensure that little or no flame actually reaches rear lip 4. This will help prevent any of the flame from travelling outward and licking up around the outer edge of deflector plate 5. In addition, skirt/plate 9 preferably extends below the plane defined by the bottom edges of lips 2 and 4 to further prevent the flame from slipping behind it.

FIG. 1 also illustrates a particularly useful advantage of the present invention. As preferably embodied, the safety device according to the invention is mounted to the stove in such way as to provide an unmistakable guide to avoid having the pot handle (A) hang over the front of the stove (dial (D) being on the front of the stove in FIG. 1).

Here, the device is placed at about the 9 o'clock position on the left-front grate shown in FIG. 1. A user will thus be guided to orient the pot (B) so that its handle (A) is positioned directly over the device. In this way, the pot handle will not hang over the front edge of the stove where it poses a serious risk that someone (especially a child) might pull down on the handle and be scalded with any hot contents of the pot, including the pot itself. It will be understood that the device is preferably mounted at about the 3 o'clock position on the right-side burners (not shown) of a stove.

Figure 4:
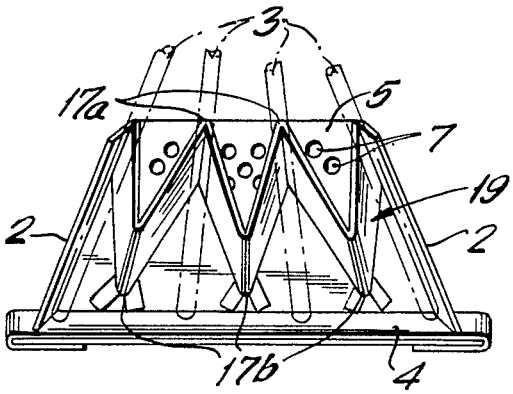
FIG. 4 is a bottom plan view, from underneath, of another embodiment of the present invention mounted on a stove grate.

FIG. 4 depicts another embodiment of the present invention. Upper deflection plate 5 may be substantially the same as that previously described with reference to FIGS. 1–3*b*. However, lower skirt/mounting member (here, indicated at 19) has a pleated or accordian configuration. Folds in member 19 produce inner and outer vertices 17*a*, 17*b*, respectively. Each inner vertex 17*a* is slitted so that when the device is placed on a stove grate, each inner vertex can be spread open to accommodate a finger 3, which is then grasped between the now-spaced apart edges of the vertex 17*a*. Mounting plate 19 is only joined to deflection plate 15 generally along outer vertices 17*b* to permit such flexing. These joints should be rugged and able to tolerate some bending and flexing. This arrangement enables the invention to be used on stove grates having either narrowly or widely spaced fingers 3 by simply spreading or separating the vertices accordingly. Thus, it can accommodate virtually any configuration of stove grate and can be easily installed and removed.

Figure 5:
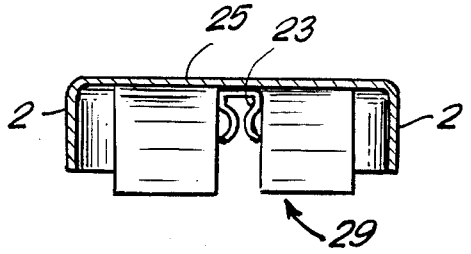
FIG. 5 is a sectional view, similar to FIG. 3*b*, of yet another embodiment of the present invention.

FIG. 5 depicts, in cross-section, another embodiment of a stove top grate safety device, having a skirt/mounting member (29) which permits the top deflection plate (here indicated at 25) to be secured atop only a single grate finger 3. This particular form of skirt mounting member 29 includes a clamp-like mounting member 23 located in the center of a flat plate-like member which depends angularly from deflection plate 25. Clamp 23 securely grasps the grate finger 3 to hold it in place. This embodiment may also be useful to those who might wish to install and remove the deflecting plate depending on the cooking utensil to be used. This embodiment may also include stabilizing fingers similar to those described hereafter with reference to FIG. 8.

Figure 7:
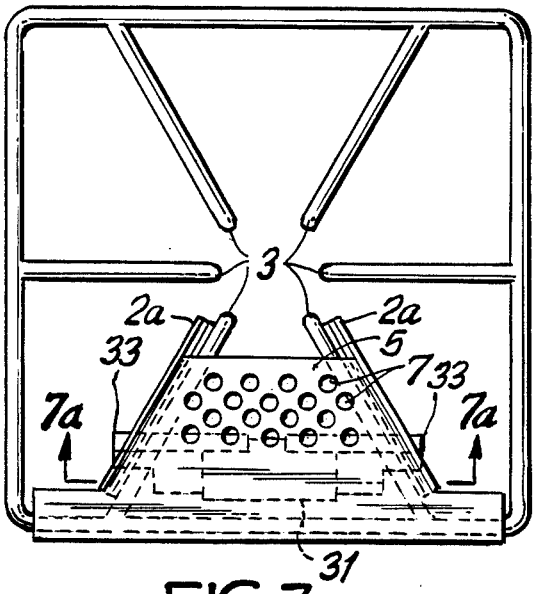
FIG. 7 is a top plan view of another modified embodiment of the present invention, which also shows how the invention can be mounted to another configuration of a stove top grate.
Figure 7B:
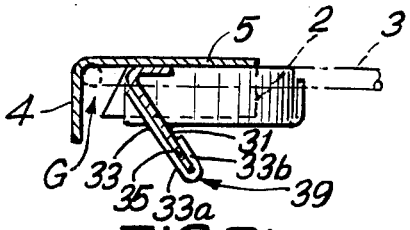
FIG. 7*b* is a cross-sectional view along line 7*b*—7*b* in FIG. 7*a*.

FIGS. 7–7*b* illustrate another embodiment of the invention, which is a modified version of the structure depicted in FIGS. 3–3*b*. It differs basically in the construction of the bottom skirt mounting member and the manner in which the device is mounted to the stove top grate. In this embodiment, the skirt/mounting member (39) includes a generally planar plate-like member 31 made of metal joined to upper deflection plate 5 by any well-known technique, including welding, brazing, soldering or mechanical fastening. As with the other embodiments disclosed herein, the angle of bend of skirt/plate 31 is preferably oriented such that it slants angularly inwardly towards the burner.

As here embodied, shutter plates 33 are slidably mounted on center plate 31. Seen from the side (FIG. 7*b*), these shutter plates are hook shaped, and preferably provide a slot 35 which frictionally engages plate 31. Shutter plates 33 are held on center tab 25 by the pinching action of front and back legs 33*a*, 33*b*, which squeeze and grip center plate 31 within slot 35 formed therebetween. (Preferably, shutter plates 33 should be made of a resilient material to maintain the gripping force.) The legs 33*a*, 33*b* must not, however, grip so tightly as to keep shutter plates 33 from being slid widthwise across center tab 31.

By moving shutter plates 33 in and out, the effective flame blocking width of mounting skirt/member 39 can be varied to fit many sizes of stove grates. Like notches 14 described with reference to FIGS. 3–3*b*, a similar notch 34 is formed in the outermost upper corners of each shutter plate 33 to allow room for a grate finger and lock the device to the grate. Thus, once the device is located in the desired position on the stove grate, shutters 33 are slid outwardly to lock the device into place.

It will also be understood that similarly formed extensible shutter-like members (indicated at 2*a* in FIGS. 7–7*b*) can also be mounted to the side lips 32 to ensure that there are little or no gaps along side lip 2 on deflector plate 5. This is particularly advantageous if there is a substantive gap (G in FIG. 7*b*) between the back edge of lip 2 and lip 4. Such a gap is present to allow accommodation for either a square or a round frame portion of a stove grate.

Figure 7C:
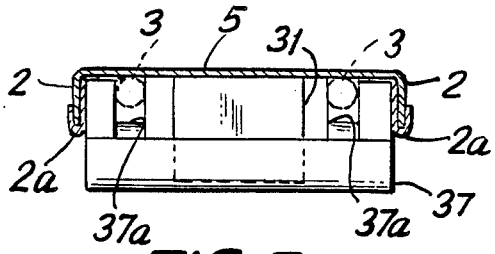
FIGS. 7*c* and 7*d* are cross-sectional views, similar to FIGS. 3*b* and 5, of a modified version of the embodiment shown in FIGS. 7–7*b*.
Figure 7A:
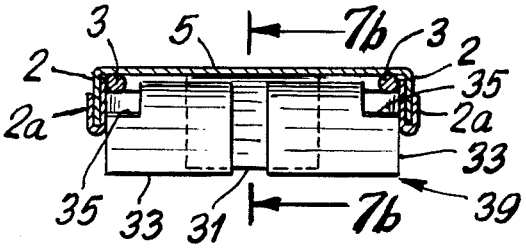
FIG. 7*a* is a cross-sectional view along line 7*a*—7*a* in FIG. 7.
Figure 7D:
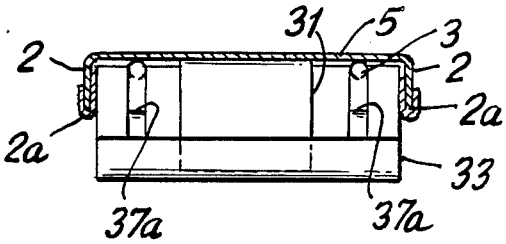

Turning then to FIGS. 7*c* and 7*d*, there is shown a further modified version of the embodiment shown in FIGS. 7–7*b*. Here, instead of extensible shutter plates, the skirt/mounting member may include fixed mounting plates (indicated at 37). As here embodied, fixed mounting plates 37 have pre-formed notches 37*a* proportioned to straddle the stove grate finger 3 of predetermined configuration. Thus, once the device is in place on a grate, it is locked by snapping an appropriately configured plate 37 (it has a folded-over bottom edge like shutters 33) onto the skirt/plate 31. Because there are several different sizes and configurations of grate fingers, it may be necessary to provide a few different plates 37 with their notches positioned and/or proportioned somewhat differently so that the device can be secured to virtually any stove grate.

Figure 8:
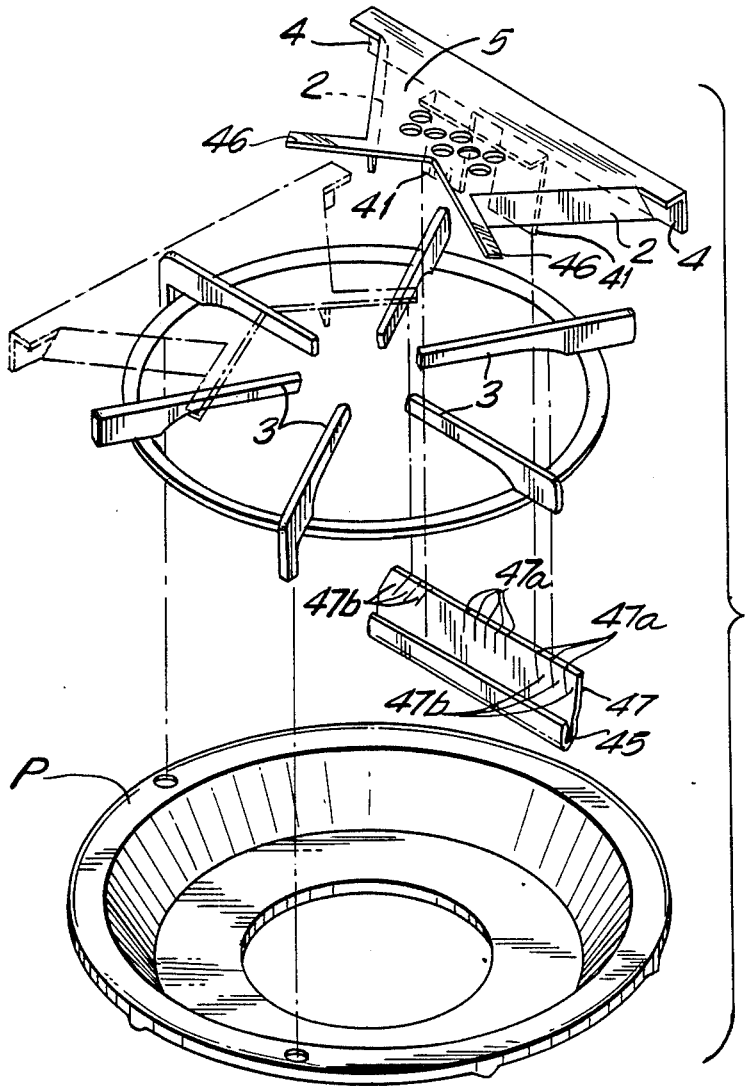
FIG. 8 is a perspective, exploded view showing another preferred form of the present invention, which also illustrates how the invention can be secured while straddling two or just one stove grate finger.
Figure 9:
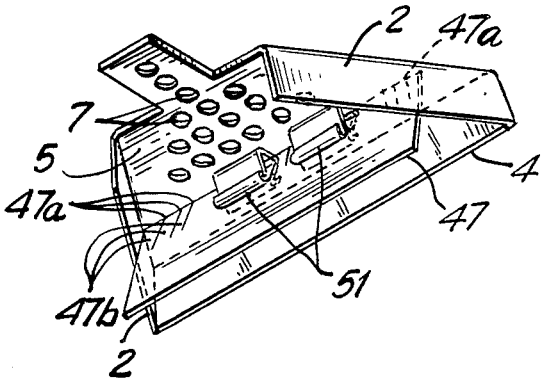
FIG. 9 is a bottom perspective view of a modified version of the embodiment depicted in FIGS. 8, 8*a* and 8*b*.
Figure 10:
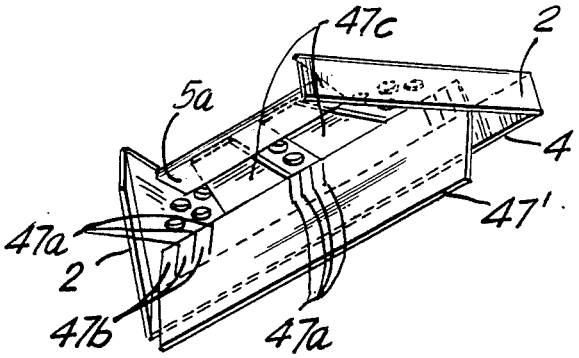
FIG. 10 is a bottom perspective view of another modified version of the embodiment depicted in FIGS. 8–8*b*.

FIGS. 8–10 show another embodiment of the present invention which advantageously can be mounted on a stove grate in a position where it overlaps either one or two grate fingers 3. These figures also help illustrate the procedure for attaching the safety device according to the invention to an existing stove top grate.

As here embodied, upper deflection plate 5 has two stabilizing tabs 46 at its front edge. These tabs are useful to support the device in a level orientation when the invention is to be positioned atop a single finger 3, as shown by the phantom lines in FIG. 8. Stabilizing tabs 46 rest atop and contact the two fingers 3 adjacent the straddled finger 3, thereby keeping the upper deflection plate from tipping.

In this embodiment, the skirt/mounting member (49) includes two angularly downwardly projecting mounting tabs 41 which are angled inward toward the burner and spaced apart by a sufficient distance to accommodate all sizes of grate fingers 3 in the middle. In addition, member 49 includes a mounting plate 47 which is similar to plates 37 in FIGS. 7*c* and 7*d*, except that, instead of including pre-formed notches (like 37*a*) plate 47 is pre-slit with several slits (each indicated at 47*a*) which provide several bendable tabs 47*b*, a sufficient number of which can be bent to form a notch which tightly fits around each grate finger regardless of its size or configuration. It will be understood that any number of slits can be used. In addition, to enable the device to be mounted with a grate finger in the middle (FIG. 8*b*), plate 47 should also be formed with two or more slits in its middle to accommodate the grate finger received in the space between the two tabs 41.

Figure 8A:
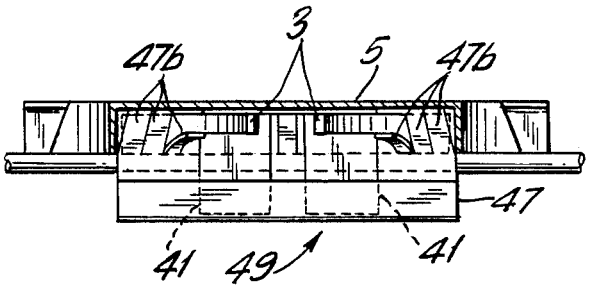
FIGS. 8*a* and 8*b* are cross-elevation views, looking radially outwardly, showing the embodiment depicted in FIG. 8 mounted in two orientations, on the left and on the right, respectively.
Figure 8B:
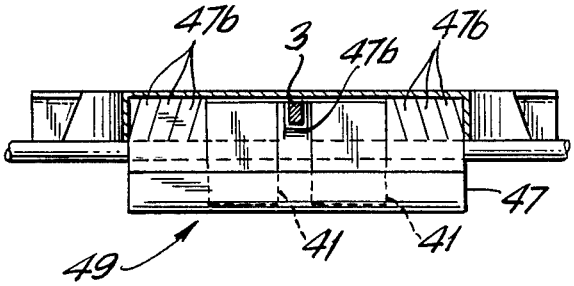

The present embodiment can thus be mounted on a stove grate in two orientations; in one, shown in FIG. 8*a*, the invention straddles two fingers 3; in the other, shown in FIG 8*b*, it straddles a single finger 3. Slitted plate 47 is secured to the pair of downwardly projecting tabs 41 by a friction fit (as described with reference to FIGS. 7–7*d*), with the end edges of tabs 41 being snugly received within the slot 45 formed between the folded over bottom edge of plate 47.

In operation, the flame deflection device of the present invention is assembled by first lifting the stove-top grate from its collection pan (P) and placing the deflection plate in the desired position over one or two grate fingers 3. The mounting plate 47 is thence urged onto tab 41 which will be grasped within slot 45. At about the same time, at least one of the tabs 47*b* adjacent each grate finger should be bent (preferably inwardly towards the burner), thereby yielding to provide room for the grate finger when plate 47 is fully seated and engaged with tabs 41.

It will be appreciated by those skilled in the art that the slit-and-tabs arrangement (47*a*, 47*b*) permit virtually universal mounting capability in that it allows the device to be used with, and secured to, grates of virtually any configuration and in virtually any position on the grate. In addition, by bending the tabs 47*b* inwardly, not only is the minimum opening produced for accommodating the grate fingers 3, but the inwardly bent tab(s) 47*b* further help to deflect the flames away from the outer edge of the grate, thereby minimizing the amount of heating on a pot handle or the like.

FIGS. 9–10 show two alternate ways of fastening the slitted plates 47 to upper deflection plate 5. In FIG. 9, clamp-like clips 51 are fixed to the bottom of deflection plate instead of plate-like tabs 41. Mounting plate 47 is grasped by these clips, which grip that plate to secure the device in place on the stove grate.

In the embodiment shown in FIG. 10, the mounting plate (here indicated at 47') includes two engagement tabs (each indicated at 47*c*) projecting angularly away from the top edge of the plate. These tabs are received within a slot (not numbered) formed by a folded-back portion (5*a*) of the upper deflection plate 5. It will be understood that the angle between fingers 47*c* and the rest of skirt 47' , should be chosen to ensure that the skirt extends angularly inwardly towards the burner. In both variations of FIGS. 9–11, the tabs 47*b* are bent as the attachment operation is being completed to accommodate the grate fingers, just as described above with reference to FIGS. 8*a*–8*b*.

The invention in its broader aspects is not limited to the specific embodiments herein shown and described.

Figure 6:
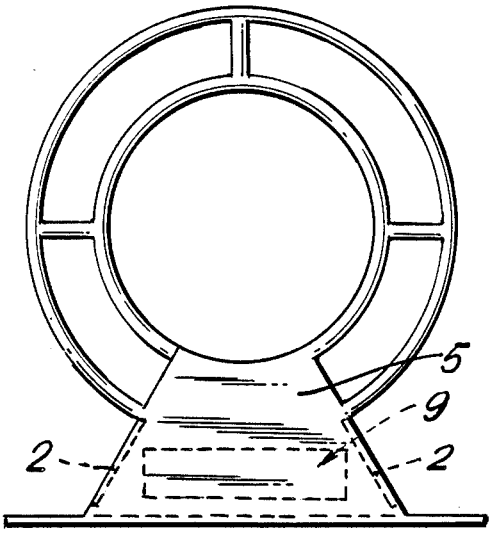
FIG. 6 is a top plan view of still yet another embodiment of the present invention, showing how the invention can be formed integrally with a stove grate.

For example, the deflection plate and protective skirt device of the invention can be formed integrally with a stove top grate as shown in FIG. 6. In addition, the deflector plate can be formed with crecent-shaped slits instead of holes. Thus, those skilled in the art will appreciate that departures may be made from the disclosed embodiments which are within the scope of the accompanying claims, without departing from the principles of the invention and without sacrificing its chief advantages.

I claim:

1. A stove-top flame safety deflector which prevents the handle of a pot or other cooking utensil from being heated higher than can be tolerated for hand contact and which can be mounted on existing stove grates located above the gas burners of a stove, which grate has a plurality of generally radially extending fingers, said deflector comprising:

a generally flat upper deflector plate formed generally in the shape of a truncated wedge said deflector plate having an inner edge facing the stove burner and an outer edge spaced from the burner, and a pair of generally oppositely disposed edges, said outer edge having a downwardly extending lip which generally abuts the stove top when said deflector plate rests atop the fingers of the stove grate;

a protective skirt member projecting angularly downwardly from said deflector plate, from its bottom, said skirt member extending lower than the lip on said outer edge when installed on a stove grate, such that when said deflector is located in desired position on the stove grate, the combination of said deflector plate, protective skirt and said outer edge lip substantially prevents flames from the burner from heating the handle beyond the level for safe hand contact.

2. A deflector according to claim 1, wherein said protective skirt comprises a protective skirt/mounting member which is further adapted to secure said device to the stove grate.

3. A stove top flame deflector as in claim 2, wherein said skirt/mounting member comprises:

a plate-like member extending downwardly from the bottom of said deflection plate; and a pair of extensible-retractable shutter plates slidably mounted to said plate-like member, said plate-like member and said shutter plates being suitably dimensioned to span the space between two adjacent grate fingers when extended to secure said device behind said fingers.

4. A deflector according to claim 3, wherein said plate-like member includes a pair of oppositely disposed top and bottom slots in which said shutters are slidably mounted.

5. A deflector according to claim 4, wherein each said shutter includes a notch proportioned to receive a grate finger to help secure the device to the grate and minimize any spacing between the skirt/mounting member and the stove grate finger, and thereby maximize the flame blocking capability of the skirt/mounting member.

6. A deflector according to claim 3, wherein each said shutter grasps said plate-like member with a pinching action.

7. A deflector according to claim 6, wherein each said shutter includes a notch proportioned to receive a grate finger to help secure the device to the grate and minimize any spacing between the skirt/mounting member and the stove grate finger, and thereby maximize the flame blocking capability of the skirt/mounting member.

8. A stove top flame deflector as in claim 3 wherein said upper deflector plate has a plurality of openings in its top surface, located inwardly of said skirt/mounting member.

9. A stove top flame deflector as in claim 1 wherein said skirt/mounting member comprises:

a plurality of V-shaped sheet metal segments each segment having an apex and an open mouth formed by the legs of the V, said segments being oriented so that said apex is disposed near said outermost edge of said deflector plate and said open mouth near said burner, said legs of each said segment being located near the legs of said adjacent segments to form V-shaped channels, so that when said mounting plate is placed on said stove grate said fingers rest in the channels between said segments.

10. A stove top flame deflector as in claim 9 wherein each said segment is joined to said deflector plate at its apex.

11. A deflector according to claim 2, wherein said skirt/mounting member includes a plate-like member extending angularly downwardly and inwardly from the bottom of said deflection plate, said plate-like member having a notch-like cut-out generally in its middle and including a clamp-like device in said slot grasping a stove grate finger to secure the device to a stove grate.

12. A deflector according to claim 2, wherein said skirt/mounting member includes:

a mounting plate attachable to said deflection plate having a plurality of slits along its top edge, said slits forming a plurality of bendable tabs, such that when said deflector is mounted to a stove grate, said mounting plate is attached to said plate-like member and only a sufficient number of tabs are bent to allow room for any grate finger grasped between said deflection plate and said mounting plate.

13. A deflector according to claim 12, which further includes a plate-like member extending angularly downwardly inwardly from the bottom of said deflection plate, said plate-like member having a notch-like cut out generally in its middle to accommodate a grate finger, and wherein said mounting plate is attachable to said plate-like member.

14. A deflector according to claim 12, which further includes a clamping means on the bottom of said deflection plate, said clamping means being adapted to secure said mounting plate to said device.

15. A deflector according to claim 12, wherein said mounting plate includes attaching means for securing said mounting plate to said deflection plate.

16. A deflector according to claim 15, wherein said attaching means comprises one or more tabs formed along the top of said mounting plate, and wherein said deflection plate includes a slot for receiving said tabs for securing said mounting plate to said deflection plate.

17. A deflector according to claim 2, which further includes a lip extending downwardly from each side edge of said deflector plate.

18. A deflector according to claim 2, which further includes vent means in said deflector plate inwardly of said skirt/mounting member to permit some direct contact between a cooking utensil seated on said deflector plate and flames emanating from a stove burner.

19. A deflector according to claim 2, wherein said safety device is secured to a grate at a location distant from the front of the stove to help guide a person to avoid orienting a cooking utensil with its handle hanging over the front of the stove.

20. A deflector according to claim 2, wherein said skirt/mounting member includes a mounting plate attachable to said deflection plate, said mounting plate having one or more notches formed therein, positioned and proportioned to accommodate generally predetermined sized and spaced grate fingers.

* * * * *